US007400240B2

(12) United States Patent
Shrode et al.

(10) Patent No.: US 7,400,240 B2
(45) Date of Patent: Jul. 15, 2008

(54) SYSTEMS AND METHODS OF DETERMINISTIC ANNUNCIATION

(75) Inventors: Jeffrey W. Shrode, Louisville, KY (US); Robert H. Brockelsby, Louisville, KY (US); Gregory P. Lindauer, Louisville, KY (US); Mark A. Butler, Elizabethtown, KY (US)

(73) Assignee: Honeywell International, Inc., Morristown, NJ (US)

( * ) Notice: Subject to any disclaimer, the term of this patent is extended or adjusted under 35 U.S.C. 154(b) by 302 days.

(21) Appl. No.: 11/204,597

(22) Filed: Aug. 16, 2005

(65) Prior Publication Data

US 2007/0040667 A1 Feb. 22, 2007

(51) Int. Cl.
*G08B 23/00* (2006.01)

(52) U.S. Cl. ..... 340/502; 340/539.1

(58) Field of Classification Search ..... 340/502, 340/506, 531, 539.1, 539.16, 539.17
See application file for complete search history.

(56) References Cited

U.S. PATENT DOCUMENTS

| | | | | |
|---|---|---|---|---|
| 4,442,426 | A * | 4/1984 | Heuschmann et al. | 340/539.22 |
| 5,568,121 | A * | 10/1996 | Lamensdorf | 340/539.17 |
| 6,252,501 | B1 * | 6/2001 | Tice et al. | 340/506 |
| 6,507,276 | B1 * | 1/2003 | Young et al. | 340/539.1 |
| 6,535,138 | B1 * | 3/2003 | Dolan et al. | 340/502 |
| 6,690,276 | B1 * | 2/2004 | Marino | 340/539.17 |
| 6,900,732 | B2 * | 5/2005 | Richards | 340/539.13 |
| 7,142,107 | B2 * | 11/2006 | Kates | 340/539.1 |

* cited by examiner

*Primary Examiner*—John Tweel, Jr.
(74) *Attorney, Agent, or Firm*—Welsh & Katz, Ltd.

(57) ABSTRACT

A method of supervising a plurality of displaced devices includes having each device emit a supervisory signal that is detectable by a designated unit. Indicia can be included indicative that an intervening message has been sent from a respective device. The designated unit can respond to missing, expected supervisory signals as well as unreceived messages.

25 Claims, 3 Drawing Sheets

10
12
12a
12b
PROCESSORS
SOFTWARE
16
18
22
24
26
30
32
34
36
36a
36b
CONTROL CIRCUITS
38
40
42

SYSTEMS AND METHODS OF DETERMINISTIC ANNUNCIATION

FIELD

The invention pertains to systems and methods to supervise the operation of other devices. More particularly, the invention pertains to such systems and methods where the devices periodically emit condition indicating signals.

BACKGROUND

Various types of monitoring systems such as fire or gas alarm systems, built-in control systems, security systems and the like carry out functions which preferably can be relied on to provide warnings relative to developing conditions which are in need of attention. It has been recognized that it is desirable to supervise the function of the components of such systems to minimize the likelihood that one or more portions of such systems might fail and not give any indication thereof. For example, where the systems are configured as networks of devices, it would be desirable to know if any transmitted messages were not received, or, if a respective device or devices had malfunctioned in some way. It would also be desirable to incorporate supervision capabilities which can be carried out automatically on an ongoing basis without substantially adding to the cost or complexity of such systems.

DETAILED DESCRIPTION

Figures 1, 1A:
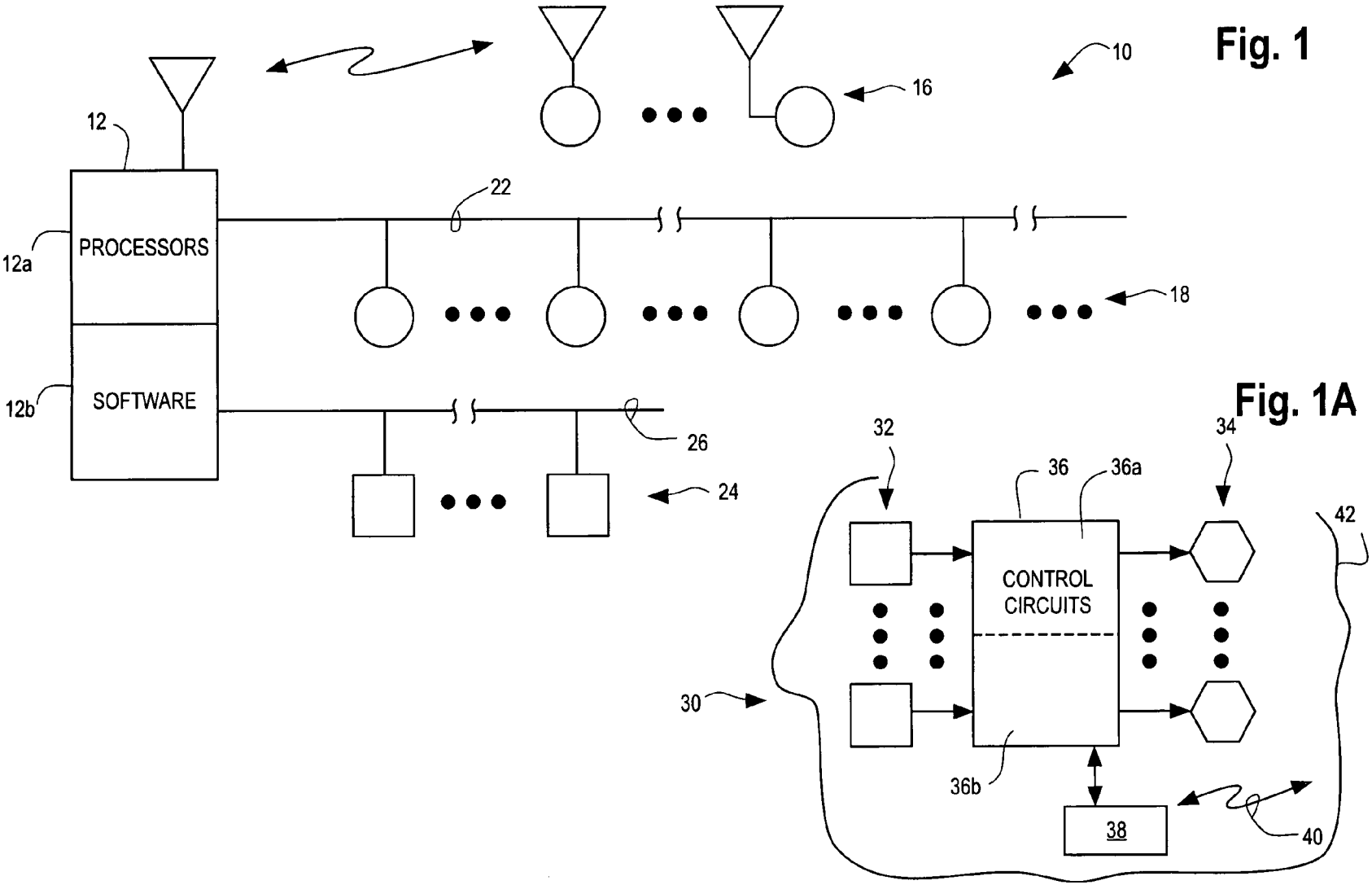
FIG. 1 is a block diagram of a system which embodies the invention.
FIG. 1A is a block diagram of a device usable in the system of FIG. 1.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Processing methods in accordance with the invention couple periodic messages from remote devices to one or more supervising devices. The messages are transmitted at predetermined, fixed time intervals. Such processing enables one or more supervising devices to determine if an event message from one of the remote devices has not been received. Further, the processing enables the receiving devices to determine when they are no longer receiving messages from one or more remote devices.

In one aspect of the invention, remote devices transmit a first message to at least one supervising device. The first messages are spaced apart by predetermined time intervals. Thus, both the remote devices and the supervising device transmit and/or receive the first messages with spaced apart durations or predefined periods.

Each of the first, or "ping", messages will include at least a first message sequence identifier. Event messages from one or more remote devices indicative of one or more sensed conditions will be transmitted to the supervising device or devices with second or event sequence identifiers. Further, each of the first messages can incorporate an event or a second message sequence identifier. Other status or condition indicating information can be included in the ping messages.

In yet another aspect of the invention, the identifier of the first and second messages can be represented as numeric values. Initially, the first and second message identifiers can be set to a value of zero when the respective device is reset.

If a supervising device has not received either a first message or a second message from respective remote devices within the predetermined period or time interval, the supervising devices can determine that the respective remote device may not be functioning properly. Audible as well as visual indicia can be provided indicative thereof.

In yet another aspect of the invention, the identifier for the initial ping message from a remote device can be transmitted having a value of zero. Such a value indicates to the supervising device that the remote device has been reset. The supervising device or devices can respond to a reset condition as is appropriate for the system.

Subsequently, the remote devices, when functioning properly, periodically transmit first messages. Each such message has an identifier that incrementally increases or decreases in value.

Where the respective remote device has detected an event which requires that an event or second message be sent to a supervising device, the first such message can be sent from the respective remote device with the second message or event sequence identifier having a value of zero. Upon sending the event message to the supervising device, that value can be incremented or decremented.

When the next time period terminates for sending a first message to the supervisory device an included second message identifier will have an altered value. The supervising device, can respond to both the first sequence identifier as well as the second sequence identifier to determine that the remote unit is transmitting first sequence identifiers periodically as required.

The supervising device can also determine if an event has been missed. If an event has been missed, the supervisory device can provide appropriate warning indicia and can request additional transmissions from the remote device.

FIG. 1 illustrates a system 10 which embodies the invention. System 10 can incorporate one or more supervisory units, such as the exemplary supervisory unit 12. The unit 12 can be implemented with or more programmable processors 12*a* and associated control software 12*b*. Neither the characteristics of the processors nor the nature and type of the software 12*b* are limitations of the invention except as described in more detail below. It will also be understood that the system 10 could be implemented as a peer-to-peer system without departing from the spirit and scope of the present invention.

The system 10 can incorporate a plurality of remote devices of various types. For example, detectors of various conditions such as a plurality of detectors 16 in wireless communication with the supervisory unit 12 as well as pluralities of detectors of various types 18 which can communicate with the supervisory unit 12 via a wire medium 22.

A plurality 24 of other types of devices, which could be output devices without limitation could be in communication with the supervisory system 12 via a wired medium 26. It will also be understood that some of the members of the plurality 16 could also be output devices.

Detectors, members of pluralities 16 or 18 can include detectors of ambient conditions without limitation such as temperature, humidity, smoke, flame, position, velocity, infrared and the like all without limitation. Output devices, plurality 24, can include without limitation solenoids, motors, audible or visual output devices and the like all without limitation.

FIG. 1A illustrates an exemplary member 30 of the pluralities 16, 18, 24. Those of skill will understand that a given device might include some or all of the indicated functionality.

Device 30 can include one or more sensors, inputs, or input devices, 32 and/or one or more outputs or output elements 34. The sensors 32 and/or output elements 34 are coupled to control circuit 36. The control circuit 36 can include at least one programmable processor 36*a* and control software 36*b*.

The control circuits 36 are also coupled to wired/wireless input/output circuitry 38 for communicating via a wired or wireless medium 40 with supervisor units such as unit 12, or, other devices. The device 30 can be carried by a housing 42.

Figure 2:
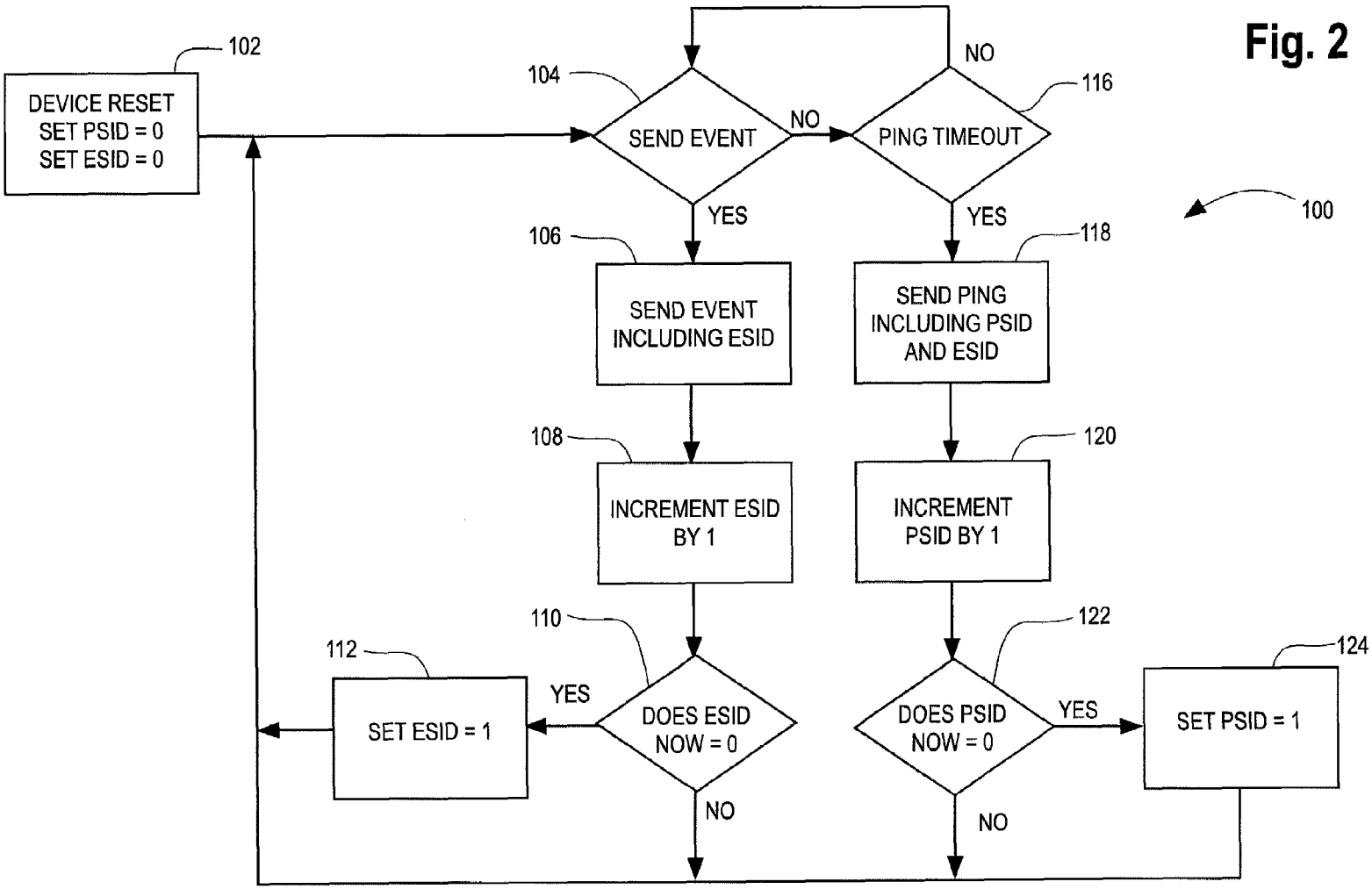
FIG. 2 is a flow diagram of processing at a device being supervised.

FIG. 2 is a flow diagram of exemplary processing which some or all of the members of the pluralities 16, 18 or 24 can carry out in accordance with the present invention. In the diagram of FIG. 2, the acronym ESID corresponds to a second message or event sequence identifier. The acronym PSID corresponds to a first message sequence identifier.

In the process 100 at FIG. 2, the respective member of the plurality 16, 18 or 24 is initially reset, step 102. In this step values of the respective PSID and ESID can be set to zero. As described above, the respective devices transmit or emit them in event indicating messages (ESID) as well as periodic ping messages (ESID, PSID).

In a step 104 in the respective device makes a determination as to whether or not an event indicating message should be transmitted to either one or more of the supervisory devices, such as device 12, or in a peer-to-peer type system to one or more other units. If so, in step 106 the appropriate message is transmitted along with the current value of ESID (transmitted as zero the first time). In a step 108 that value is incremented by one.

In a step 110 a determination has been made as to whether or not the ESID value has rolled over (for example values will roll over once they reach a value of 255 if 8 bit representations are used). If so, the ESID value is reset to a value of one in a step 112.

Where an event message need not be sent, step 104, a determination is made, step 116 as to whether the predetermined period has lapsed. If the time interval for sending the first message has lapsed, that message is transmitted or sent in step 118. In this event, both the ping sequence identifier value and event message sequence identifier value are also transmitted to the supervisory device.

In a step 120 the first message sequence identifier is incremented. Where that value has rolled over and equals zero, step 122 it is reset to a value of one, step 124.

Members of the pluralities 16, 18 and 24 continually repeat the process 100 in normal operation. If a given device fails, or, there is some disruption of the transmission medium, the supervisory device 12 will be able to determine one or more ping messages have not been received as illustrated by the processing 200 of FIG. 3.

Figure 3:
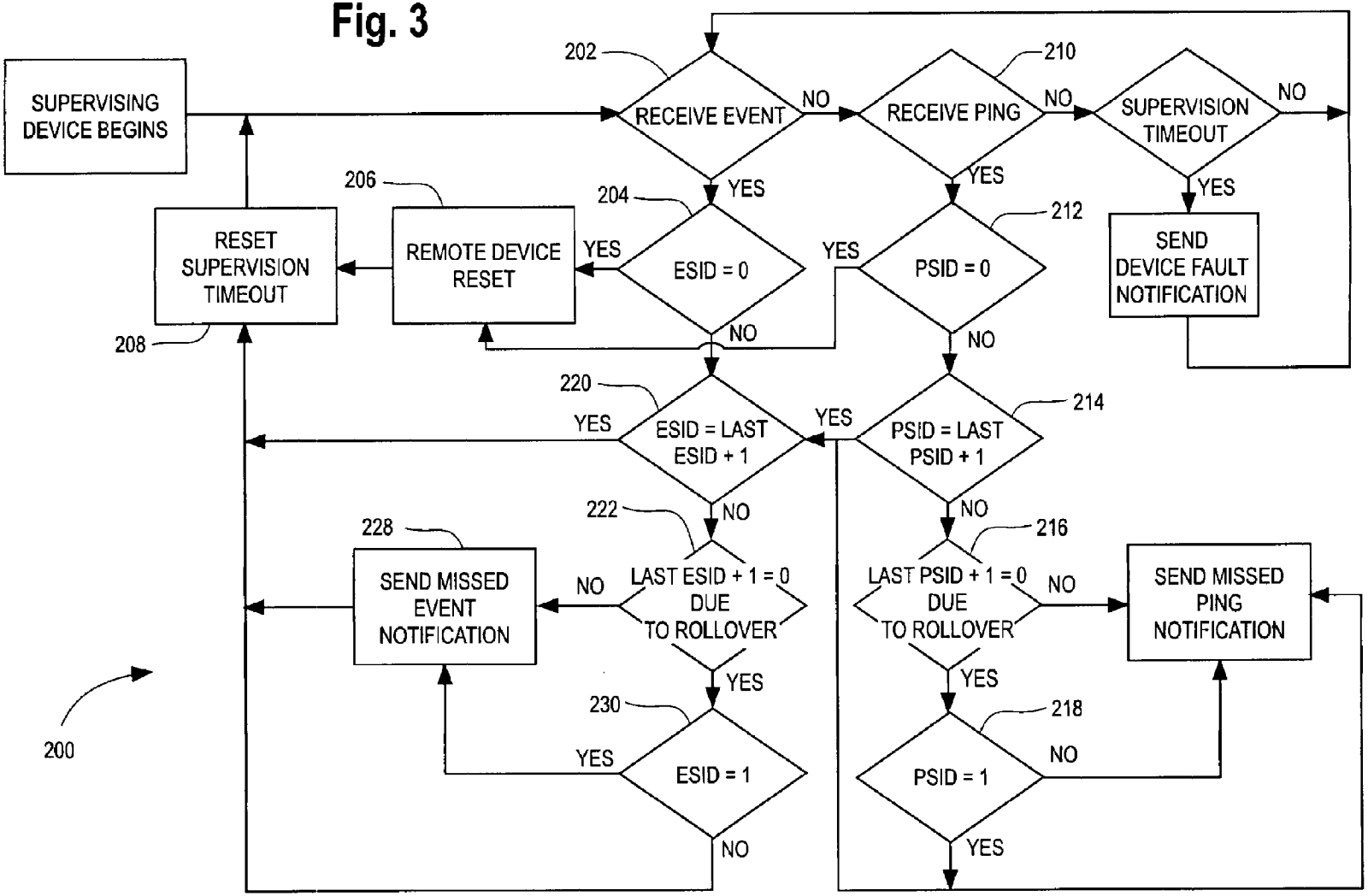
FIG. 3 is a flow diagram of processing at a supervisory unit usable in the system of FIG. 1.

The processing 200 of FIG. 3 can be carried out at supervisory unit 12. Alternately, in a peer-to-peer operating system that processing might be carried out in one or more of the distributed units all without limitation.

Where a supervisory device receives an event message, step 202 it evaluates the value of the second message or event sequence identifier, step 204. If that value is zero, it is indicative of the fact that the respective device has been reset, step 206. In this circumstance, the supervisory time out interval can be reset, step 208.

Where a ping message has been received, step 210 and the associated PSID, first message sequence identifier has a value of zero, step 212 processing returns to step 206. Alternately, in step 214, the PSID value is incremented and checked for rollover, step 216. If so, the PSID value is set to the numeric value of one, step 218 and process 200 executes step 220.

In the event that the second message or event sequence identifier value is not equal to the prior ESID incremented by one, then the value is checked to determine if it equals zero, step 222. If not, an event missed indicium can be produced, step 228. That indicium can be transmitted to one or more of the members of the plurality 16, 18 or 24 as well as presented audibly or visually for an operator's response. Otherwise, in step 230 the current ESID value is evaluated, if it equals 1, the supervisory timeout is reset, step 208, and the process 200 continues.

The above described processes 100, 200 are continually repeated by the respective members of the pluralities 16, 18, 24 or the supervisory system or systems 12. It will be understood that the various steps of the processes 100, 200 and can be modified or added to without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A supervisory process comprising:

periodically sending a first identifier from a device being supervised, the identifiers are temporally spaced apart by a predetermined period;

non-periodically sending an event message upon the occurrence of the event; and sensing received identifiers; and, determining if each such identifier has been received displaced in time from a prior received identifier an amount on the order of the period.

2. A process as in claim 1 where in response to not receiving a subsequent identifier after a time interval on the order of the period, a trouble indicating indicium is generated.

3. A process as in claim 1 where an indicium is generated in response to receiving a current identifier after a delay, on the order of the period, in receiving a prior identifier.

4. A process as in claim 1 which includes maintaining a record of received identifiers and times of receipt thereof.

5. A process as in claim 4 which includes generating at least one of an audible indicator or a visual indicator indicative of an expected but unreceived identifier.

6. A process as in claim 1 which includes sending a second identifier from the device, the second identifier is indicative of an antecedent event indicating indicium.

7. A process as in claim 6 which includes ascertaining if the event indicating indicium had previously been received.

8. A process as in claim 6 which includes sending an event indicating indicium in response to a predetermined condition.

9. A process as in claim 8 which includes associating an event indicating second identifier with each event indicating indicium.

10. A process as in claim 9 which includes altering each second identifier in association with sending each event indicating indicium.

11. A process as in claim 10 where each second identifier includes at least a numeric portion with the altering including one of incrementing or decrementing the numeric portion.

12. A process as in claim 8 which includes altering the first identifier in association with sending each such identifier.

13. A process as in claim 12 which includes altering the first identifier subsequent to sending each such identifier.

14. A process as in claim 13 where the first identifiers include a numeric portion with the altering including one of incrementing or decrementing the numeric portion.

15. A system comprising:

a plurality of electrical units;

a monitoring device where the electrical units communicate with the device via a medium;

the electrical units each include circuitry to produce a plurality of indicia indicative of expected functioning of the respective unit, the indicia are coupled to the monitoring device, the electrical units also each include circuitry to produce indicia of a predetermined physical event, the indicia of the predetermined physical event coupled to the monitoring device upon occurrence of the event.

16. A system as in claim 15 where the circuitry produces a plurality of temporally displaced indicia.

17. A system as in claim 16 where the monitoring device includes software to evaluate indicia received from respective units.

18. A system as in claim 16 where the device includes circuitry to sense a temporal displacement between adjacent indicia received from the same unit.

19. A system as in claim 18 where the device includes circuitry responsive to a temporal displacement that exceeds a predetermined value.

20. A system as in claim 19 where the device generates an indicium measuring indicator where the temporal displacement exceeds the predetermined value.

21. A device comprising: at least one ambient condition sensor; output circuitry to periodically transmit identifiers indicative of an expected operational state and also to non-periodically transmit notice of an event detected by the at least one ambient condition sensor upon detection of the event.

22. A device as in claim 21 which includes control circuits coupled between the sensor and the output circuitry.

23. A device as in claim 22 where the control circuits, via the output circuitry, transmit event indicating indicia via a medium.

24. A device as in claim 21 where the output circuitry transmits identifiers which include a transmission identifier.

25. A device as in claim 23 where the control circuits transmit event indicating indicia which include, at least in part, an event identifying numeric.

* * * * *